United States Patent [19]

Popeil et al.

[11] Patent Number: 4,948,106

[45] **Date of Patent: * Aug. 14, 1990**

[54] FOOD CUTTING APPARATUS

[75] Inventors: Ronald Popeil; Alan Backus, both of Los Angeles, Calif.

[73] Assignee: Popeil Industries, Inc., Beverly Hills, Calif.

[ * ] Notice: The portion of the term of this patent subsequent to Feb. 28, 2006 has been disclaimed.

[21] Appl. No.: 236,025

[22] Filed: Aug. 24, 1988

Related U.S. Application Data

[63] Continuation of Ser. No. 906,594, Sep. 9, 1986, Pat. No. 4,807,862, which is a continuation-in-part of Ser. No. 848,631, Apr. 4, 1986, abandoned.

[51] Int. Cl.[5] ..... B26D 7/02

[52] U.S. Cl. ..... 269/87.2; 269/295; 83/762

[58] Field of Search ..... 269/87.2, 295, 289 R, 269/290, 291, 292, 288, 303; 83/762–764, 466.1, 454, 455, 467

[56] References Cited

U.S. PATENT DOCUMENTS

| | | | |
|---|---|---|---|
| 1,764,235 | 6/1930 | Wilmking | 83/762 |
| 2,108,992 | 2/1938 | Obenshain | 83/762 |
| 2,206,154 | 7/1940 | Biner | 83/762 |
| 3,347,296 | 10/1967 | Rothman | 269/87.2 |
| 3,452,795 | 7/1969 | Davies | 83/762 |
| 3,583,026 | 6/1971 | Peoni | 269/87.2 |
| 4,131,043 | 12/1978 | Colman et al. | 83/762 |
| 4,140,340 | 2/1979 | Cloutier | 269/295 |
| 4,249,445 | 2/1981 | Browning | 83/762 |
| 4,399,989 | 8/1983 | Baillie | 83/762 |
| 4,550,636 | 11/1985 | Josselson et al. | 83/762 |
| 4,807,862 | 2/1989 | Popeil et al. | 269/87.2 |

*Primary Examiner*—Robert C. Watson
*Attorney, Agent, or Firm*—Lyon & Lyon

[57] ABSTRACT

An apparatus for the cutting of food includes a uniquely-shaped cavity for positioning and retaining food articles of varying size and a pair of slots for guiding a cutting implement.

3 Claims, 2 Drawing Sheets

FOOD CUTTING APPARATUS

This application is a continuation of application serial no. 906,594, filed Sept. 9, 1986, now U.S. Pat. No. 4,807,862 which is a continuation-in-part of application serial no. 848,631, filed Apr. 4, 1986, now abandoned.

BACKGROUND OF THE INVENTION

The field of the present invention is apparatus for the cutting of food.

In cutting and slicing food, particularly bread products, it is often desirable to sever the food article into more or less symmetrical halves. To do so, the food preparer must generally hold the food article in one hand and a knife or other cutting utensil in the other hand. During cutting, the food article must be observed to insure that the cutting utensil does not stray from the desired line of symmetry. This requires careful monitoring of the position and movement of the cutting utensil along two degrees of freedom, its angle with respect to vertical and its angle with respect to horizontal. The result is often an asymmetrical severing of the food article and a jagged, unattractive cut. Moreover, serious accident can result should the cutting implement slip. This is particularly a problem where the food article has been stored at very low temperatures.

SUMMARY OF THE INVENTION

The present invention is directed to an apparatus for the cutting of food products. To this end, a vessel of unique shape is provided having a cavity adapted to receive and position a food article. Apertures are associated therewith to permit the passage of a cutting implement. Should further cutting be required, a pair of paddles adapted to be positioned within the cavity may be employed.

DETAILED DESCRIPTION OF THE PREFERRED EMBODIMENT

Figure 1:
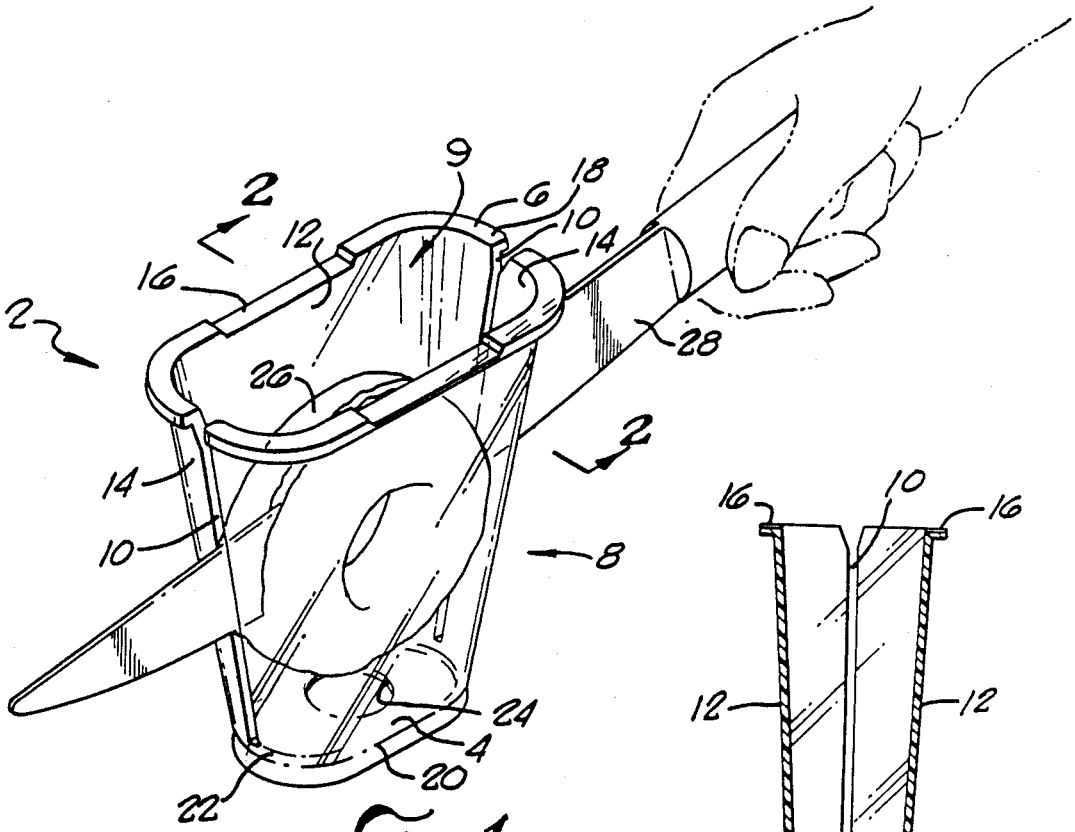
FIG. 1 is a perspective view of a food slicing apparatus constructed in accordance with the present invention showing an article of food positioned therein and an implement engaged in slicing the food article.
Figure 2:
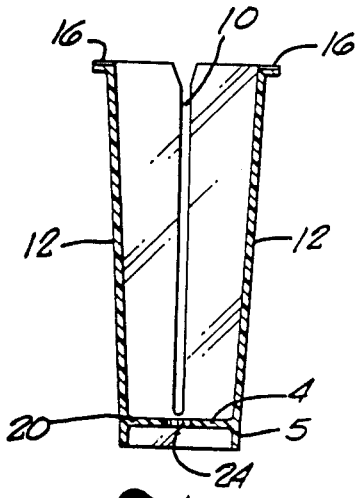
FIG. 2 is a cross-sectional end view taken along line 2—2 of FIG. 1 illustrating The base, lip and side portions of the apparatus of FIG. 1.

Referring to FIG. 1, a vessel 2 formed from acrylic or any other subtitle heat and abrasion resistant material, comprises a base 4, a lip 6, and a side wall portion 8 extending between the lip 6 and the base 4. The side wall portion 8 and the base 4 define a chamber 9 adapted to receive an article of food for cutting. A pair of opposing slots 10 are disposed in the side wall portion 8 and extend from the lip 6 to the base 4 or, if desired, to lust short of the base 4. As shown in FIG. 2, the slots 10 are oriented perpendicularly to the base 4 when the slots are viewed in alignment with respect to one another. Disposed beneath the base 4 and providing support for the vessel 2 is a supporting wall 5.

Figure 4:
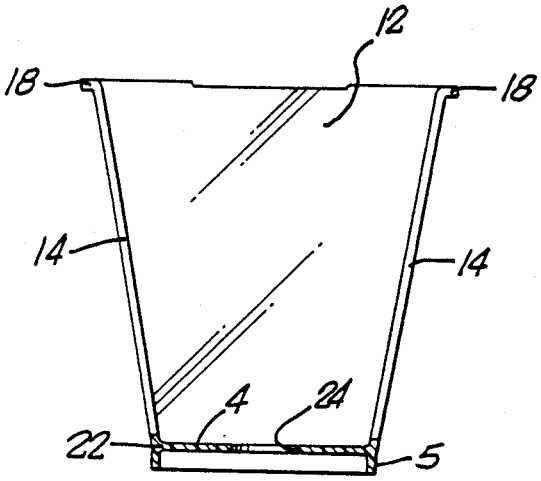
FIG. 4 is a cross-sectional side view taken along line 4—4 of FIG. 3.
Figure 3:
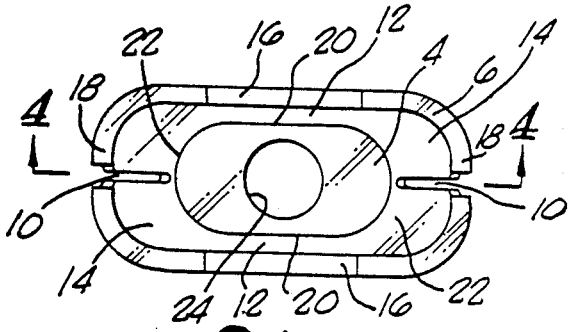
FIG. 3 is a plan view of the apparatus of FIG. 1 taken above the lip thereof and showing the side and base portions.

Referring to FIGS. 2, 3 and 4, it will be seen that side wall portion 8 is comprised of a pair of straight side walls 12 and a pair of walls 14 that are curved when viewed in plan but planar when viewed in side cross-section. Corresponding to the side walls 12 and the end walls 14 of the wall portion 8 are side portions 16 and end portions 18 of the lip 6, and side portions 20 and end portions 22 of the base 4. Centrally disposed in the base 4 is an aperture 24 to facilitate removing The food article.

It will be seen that the cross-sectional area of the cavity 9, as viewed in plan, increases from the base 4 to the lip 6. This increase in size occurs in two directions by virtue of the fact that each of the side walls 12 and each of the end walls 14 diverges from its counterpart side or end wall from the base 4 to the lip 6. Thus, the cavity 9 is longer and wider in plan than the base 4 at the ends of the side wall portion 8.

As shown in FIG. 1, an elongated food article 26, which is a bagel in this case, is placed in the cavity 9 for bisection into elongated. Due to the varying cross-sectional area of the cavity 9, food articles of widely varying size and shape may be used. The operator need only push the article toward the base 4 until it becomes firmly lodged against the side walls 12 and the end walls 14. Once lodged in position, the article will be centered and retained by the side walls 12 and the curved end walls 14. The end walls 14 also serve to prevent rotation during cutting. To cut the food article, a knife or other cutting implement 28 is inserted in the slots 10 and drawn toward the base 4. A sawing motion will aid this cutting process. Once the Food article 26 is sliced and the cutting implement 28 removed, the article can be removed from the cavity 9 by pushing through the hole 24.

Figure 5:
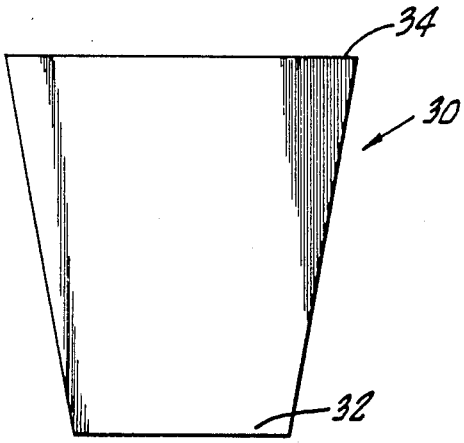
FIG. 5 is a plan view of a paddle adapted to be positioned in the food slicing apparatus of FIG. 1.
Figure 6:
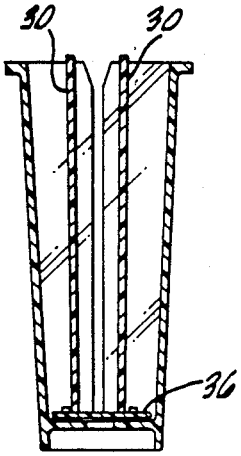
FIG. 6 is a cross-sectional view of the food slicing apparatus of FIG. 1 showing the paddles of FIG. 5.
Figure 7:
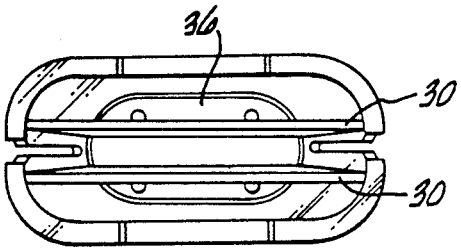
FIG. 7 is a plan view of the apparatus of FIG. 1 showing the paddles of FIG. 5.

Should further cutting of the food article 26 be required, a pair of paddles 30 of generally trapezoidal shape, having narrow ends 32 and broad ends 37, are provided as shown in FIGS. 5–7. The paddles 30 are constructed of acrylic or other suitable abrasion-resistant material and are adapted for placement within the cavity 9 on either side of the slots 10. To rebisect a previously bisected food article, the article is placed between the paddles 30 and lowered into the cavity 9 with the narrow ends 32 pointing toward the head 4. As the paddles 30 are lowered, they will become sandwiched between the side and end walls 12 and 14 of the vessel 2, thereby positioning the food article for further slicing by the cutting implement 28. This procedure can be repeated until either the desired cutting thickness is obtained or until the food article is too structurally unsound to accept further cutting.

Figure 8:
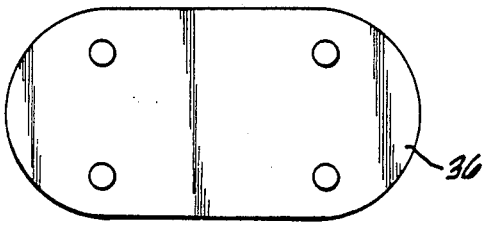
FIG. 8 is a plan view of a protective plate member.

FIG. 8 shows a protective plate member 36 adapted for placement at the bottom of the chamber 9 as shown in FIGS. 5 and 7. The plate 36 is constructed of abrasion-resistant material and is intended to protect the surface of the base 4 from the cutting implement 28 and to facilitate removal of the food article 26.

Thus, an apparatus for the cutting of food is disclosed wherein a vessel comprising a uniquely shaped cavity is used to position and support an article of food for cutting. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An apparatus for cutting an article of food comprising a base, a lip and a chamber defined by walls extending between said base and said lip for holding an article of food, a pair of slots disposed in said walls being adapted to receive a cutting utensil, an aperture disposed in said base adapted to allow insertion of an implement into said chamber in order to remove an article of food from said chamber, and a protective plate element removably disposed in said chamber and extending parallel to the plane of said base in order to protect said base from a cutting utensil.

2. An open ended vessel for holding and positioning a bagel, roll or other bread product for bisection comprising an elongated base, a pair of side walls and a pair of end walls extending from said base to define an elongated open ended chamber adapted to receive and support said bread product for cutting along a plane of cutting extending through said end walls along said plane of cutting, said slots being adapted to receive a cutting utensil, and a protective plate element removably disposed in said chamber and extending parallel to the plane of said base in order to protect said base from a cutting utensil.

3. An open ended vessel for holding and positioning a bagel, roll or other relatively thin bread product for bisection along the thin axis thereof comprising an elongated base and walls extending from said base defining an elongated open ended chamber, said chamber having a minor dimension extending parallel to the plane of said base and corresponding to the thin dimension of said bread product to provide lateral support of said bread product for slicing, said chamber further having a first major dimension extending parallel to the plane of said base and corresponding to a major dimension of said bread product to further support said bread product for slicing, said chamber further having a second major dimension extending normal to the plane of said base and corresponding to a second major dimension of said bread product in order to further support said bread product for slicing, a protective plate element removably disposed above said base in order to protect said base from a cutting implement, and a pair opposing slots disposed in said walls extending normal to the plane of said base and forming a plane of cutting through said bread product, whereby said bread product may be bisected by placing said bread product in said chamber and drawing a cutting implement through said slots.

* * * * *